US005097238A

United States Patent [19]

Sato et al.

[11] Patent Number: 5,097,238

[45] Date of Patent: Mar. 17, 1992

[54] DIELECTRIC RESONATOR DEVICE

[75] Inventors: Manabu Sato; Takeo Kinoshita, both of Nagoya, Japan

[73] Assignee: NGK Spark Plug Co., Ltd., Nagoya, Japan

[21] Appl. No.: 574,116

[22] Filed: Aug. 29, 1990

[30] Foreign Application Priority Data

Aug. 31, 1989 [JP] Japan ..... 1-102716[U]

[51] Int. Cl.[5] ..... H01P 7/10

[52] U.S. Cl. ..... 333/219.1; 333/234

[58] Field of Search ..... 333/202, 219, 219.1, 333/234; 331/96, 117 D, 107 DP, 68

[56] References Cited

U.S. PATENT DOCUMENTS 4,136,320 1/1979 Nishikawa et al. ..... 333/234
4,620,168 10/1986 Delestre et al. ..... 333/202
4,639,699 1/1987 Nishikawa et al. ..... 333/219.1 X
4,757,289 7/1988 Kosugi et al. ..... 333/235 X

FOREIGN PATENT DOCUMENTS 0075602 4/1986 Japan ..... 333/219.1
0258505 11/1986 Japan ..... 333/234

*Primary Examiner*—Eugene R. LaRoche
*Assistant Examiner*—Seung Ham
*Attorney, Agent, or Firm*—Larson & Taylor

[57] ABSTRACT

A dielectric resonator device comprising a resonator body having a dielectric resonator element, a supporting member and a mounting flange which are integrally formed and are made of the same dielectric ceramic material, the mounting flange having an effective heat dissipating function and being removably fixed on a base member.

3 Claims, 2 Drawing Sheets

DIELECTRIC RESONATOR DEVICE

BACKGROUND OF THE INVENTION

The present invention relates to a dielectric resonator device which may be used as a filter or an oscillator in microfrequency regions.

There is a known dielectric resonator device in which a dielectric resonator element is mounted on an inner base wall of a shield casing via a supporting member. An example of such a dielectric resonator device is illustrated in FIG. 1. As will be seen in FIG. 1, it comprises a dielectric resonator element A of a circular or rectangular shape in cross section, a metal casing B for containing the resonator element A and an insulating holder member C made of alumina or forsterite. The resonator element A is mounted on the base portion of the metal casing B by the insulating holder member C so that the resonator element A has a desired Q-characteristic. That is, the resonator element A is connected with the upper portion of the insulating holder member C by means of a heat-resisting adhesive layer D of an adhesive containing a glass glaze as a main component, silica containing adhesive or the other adhesive. The insulating holder member C has a lower portion connected with the inner portion of an annular metal flange E by an adh sive layer F. The annular metal flange E is fixed on the metal casing B by means of bolts G.

With the arrangement that the resonator element A and the insulating holder member C are supported by the annular metal flange E, the bottom surface of the holder member C is not directly mounted on the base portion of the metal casing B by an adhesive or the like. After the respective elements are assembled, therefore, the assembled elements can be mounted on the case portion of the metal casing B by fastening the bolts G and thus the assembly can be easily dismounted so that the resonator element A can be optionally replaced with a new one or transferred.

When the resonator device is operated, the resonator element A is self-heated with the resonance thereof. In particular, when the resonator is actuated with higher power, the higher the operation frequency is the larger the heat release value in the resonator element.

The adhesive layers D and F have a poor heat transfer efficiency because it contains air bubbles. Therefore, the adhesive layers D and F make it difficult to transfer the heat in the resonator element to the insulating holder member C.

There may occur a heat-accumulation in the resonator element A so that it has a higher temperature. As a result, there may occur a pull-up between the resonator element A and the insulating holder member C or between the insulating holder member C and the flange E because of difference in a temperature-coefficient of linear thermal expansion therebetween, and the resonance characteristic of the device may be varied.

Since the flange E is of metal, the resonator device has a disadvantage that Q-value may be reduced because of conductor loss thereof.

Further, since the insulating holder member C and the flange E are providing for mounting the resonator element A on the base portion of the metal casing B, the number of parts is increased and it is necessary to perform the connecting between the resonator element A and the insulating holder member C and between the insulating holder member C and the flange E, which results in expensive device.

SUMMARY OF THE INVENTION

It is therefore an object of the present invention to provide a dielectric resonator device capable of overcoming said disadvantages in the prior art, being simply assembled and having an excellent heat dissipation.

According to the present invention, there is provided a dielectric resonator device comprising a dielectric resonator body of dielectric ceramics having a resonator portion, a supporting portion and a mounting flange portion provided on the lower end of the supporting portion which are integrally formed, a base member for mounting the dielectric resonator body, and fastening members for removably fixing the mounting flange on the base member.

The resonator portion and supporting portion of the dielectric resonator body may be provided with a through hole extending along the center axis thereof.

The through hole may be intended for expediting a heat dissipation or additionally for tuning the resonant frequency by inserting a tuning member of dielectric material thereinto.

The resonator portion and supporting portion of the dielectric resonator body may be of circular or rectangular cross section, and the mounting flange portion may be of annular.

Furthermore, the base member may be a portion of a casing for containing the resonator body.

Since the resonator portion and supporting portion of the dielectric resonator body are integrally formed and thus there is no adhesive layer therebetween, even if the resonator portion generates a heat as the result of a resonance, the generated heat may be quickly transferred to supporting portion and then the mounting flange portion. Further, By provision of the mounting flange portion which is made of the same material as that of the resonator portion and supporting portion and is integrally formed, no conductor loss is generated and Q-value may be increased.

In case the fastening members are made of ceramic material, there is provided no metal potion and thus Q-value may be more increased.

The present invention will now be described by way of example with reference to the accompanying drawings:

DETAILED DESCRIPTION

Figure 1:
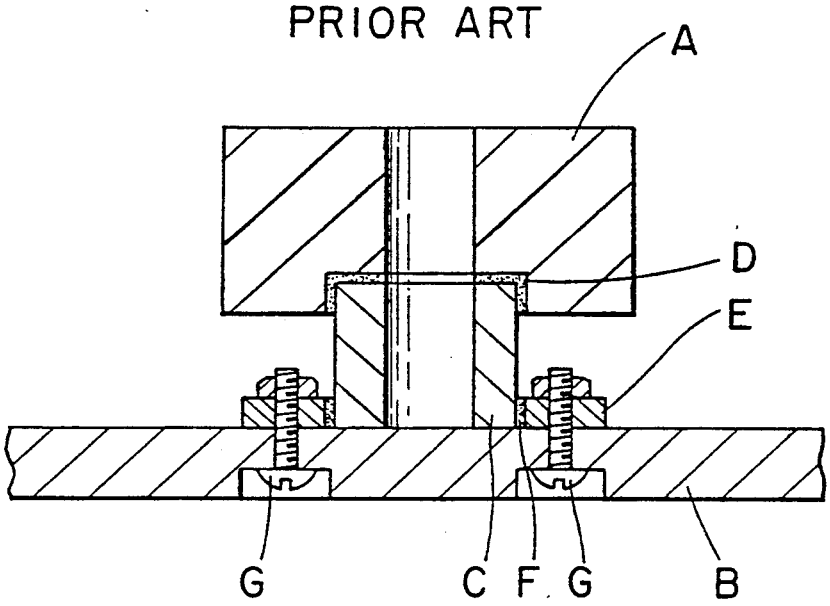
FIG. 1 PRIOR ART
FIG. 1 is a side view schematically showing a conventional dielectric resonator device, parts being broken away.
Figure 2:
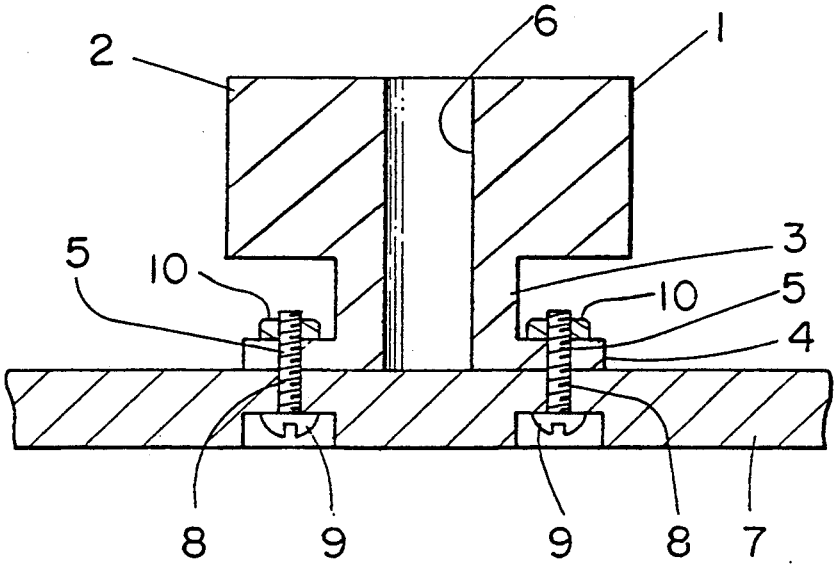
FIG. 2 is a partially cutaway side view schematically showing a dielectric resonator device according to the present invention.
Figure 3:
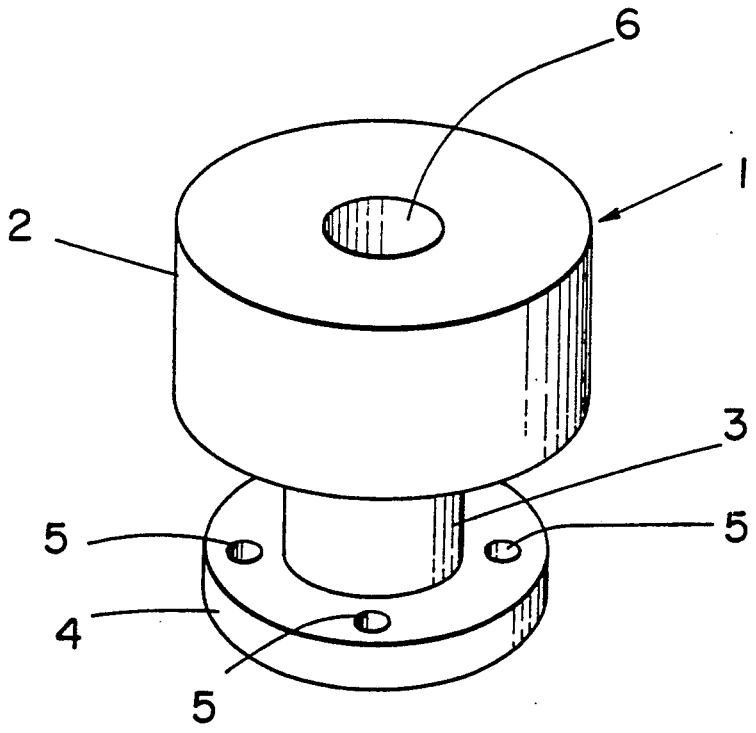
FIG. 3 is a perspective view showing a resonator body of FIG. 2.

Referring to FIG. 2, there is shown a dielectric resonator device according to the present invention.

The reference numeral 1 respresents a dielectric resonator body which may be of dielectric ceramic material such as $TiO_2$, $BaO\text{-}TiO_2$. This dielectric resonator body 1 comprises a resonator portion 2 having a circular cross section of a larger diameter, a supporting portion 3 having a circular cross section of a smaller diameter, and an annular mounting flange portion 4 which are integrally formed by means of press molding or other suitable method. The mounting flange portion 4 is positioned around the lower end of the supporting portion 3 and is provided with four bolt mounting holes 5 separated by equal spaces. The reference numeral 6 represents a though hole which is provided along the center axis of the resonator portion 2 and the supporting portion 3 of the dielectric resonator body 1.

The reference numeral 7 represents a base portion of a metal casing. The base portion 7 is provided with four openings 8 through which fastening bolts 9 of dielectric ceramic material are inserted into the bolt mounting holes 5 of the flange 4 and are fastened with nuts 10 of dielectric ceramic material for clamping the dielectric resonator body 1 on the base portion 7.

Alternatively, each mounting hole 5 of the flange 4 may be provided with an internal thread with which the associated bolt 9 is engaged. In such a case the nuts 10 may be omitted.

With the illustrated arrangement, when the resonator body 1 is activated, the heat generated in the resonator portion 2 can be quickly transferred to the supporting portion 3 and the mounting flange portion 4, and can be expedited so that the resonator portion 2 can be prevented from raising in the temperture. In particular, the mounting flange portion 4 may operate as a heat radiating means for increasing a heat radiating effect.

Also, the hole through hole 6 is intended to increase the contact area between the resonator body 1 and the atomosphere thereby expediting a heat dissipation.

By way of example, with the resonator device constructed in accordance with the illustrated embodiment in which the resonator portion 2 has an outer diameter of 70$\phi$ and a height of 35 mm, the through hole 6 has an inner diameter of 22$\phi$, the supporting portion 3 has a height of 15 mm, the mounting flange 4 has an outer diameter 50$\phi$ and a thickness of 5 mm, the inner diameter of each clamping hole 5 is 3.5 mm, there was obtained Q-value of 30,000 at applied frequency of 850 MHz.

On the contrary, with the resonator device having a metal flange and constructed with same dimensions as that of the above arrangement, Q-value was 2500 at the same applied frequency.

It will, therefore, be understood that the resonator device according to the embodiment of the present invention has Q-value which is very larger than that of the conventional arrangement.

With a modified embodiment of the present invention, instead of the through hole a bottomed hole or counter-bored hole may be provided along the center axis of the resonator portion 2 of the resonator body 1.

Alternatively, the resonator body 1 may be constructed in a solid form. In this case, a desired heat dissipation function may be obtained.

With the illustrated embodiments, although the resonator portion 2 and the supporting portion 3 of the dielectric resonator body 1 are of a circular cross section, it is appreciated that they may be formed to have a rectangular cross section or a polygonal cross section.

Additionally, the hole provided in the dielectric resonator body 1 may be used to tune the resonant frequency to an intended level. That is, the tuning of the resonator frequency may be performed by inserting loosely a tuning rod of dielectric material into the hole and adjusting the position or level of the inserted tuning rod in the hole.

Finally, the dielectric resonator body in the illustrated embodiment may be applied to a stripline arrangement. In this case, a dielectric substrate may be used as the base member, on the upper surface of which the resonator arrangement may be mounted.

As illustrated and described above, according to the present invention, since the resonator element, its supporting member and mounting flange are integrally constructed by using suitable dielectric materials and the mounting flange has an effective heat dissipating function, any provision of an adhesive layer between the resonator element and the supporting member can be avoided, no heat insulating layer is formed, and a heat dissipation in the resonator body can be substantially improved, thereby preventing the resonator element from getting a high temperature. As a result, there can be avoided any removing of the resonator device and any deterioration in a resonant frequency characteristic of the resonator device, and thus the resonance characteristic of the resonator device can be stabilized.

Further, since the respective portions of the resonator body are integrally formed, the present invention has an advantage that it is possible to reduce the number of parts necessary for assembling the resonator device and to simplify the manufacture in the point of jointing procedure. This results in a cheaper device.

Furthermore, by provision of mounting flange of dielectric ceramic material but not metal material, Q-value to be obtained can be effectively increased.

It is to be understood that the present invention in not restricted to the particular embodiments illustrated and that numerous modifications and alternations may be made by those skilled in the art without departing from the spirit and scope of the invention.

What is claimed is:

1. A dielectric resonator device comprising a dielectric resonator body of dielectric ceramics having a resonator portion, a supporting portion and a mounting flange portion provided on the lower end of said supporting portion, a base member for mounting the dielectric resonator body, and fastening members for removably fixing the mounting flange on the base member, wherein the resonator portion, the supporting portion and the mounting flange portion are integrally formed, the mounting flange portion of said resonator body and said base member are provided with bores through which said fastening members are fastened, and said fastening members comprise bolts and nuts of dielectric ceramic material.

2. A dielectric resonator device according to claim 1, wherein said resonator body is provided with an inner hole which extends along the center axis of the resonator portion and the supporting portion thereof.

3. A dielectric resonator device according to claim 1, wherein said base member is a portion of a metal casing for containing the resonator body.

* * * * *